US006125938A

United States Patent [19]

Garcia-Soule et al.

[11] Patent Number: 6,125,938

[45] Date of Patent: Oct. 3, 2000

[54] CONTROL MODULE SYSTEM FOR SUBTERRANEAN WELL

[75] Inventors: Virgilio Garcia-Soule, Irving; Kenneth L. Schwendemann, Lewisville, both of Tex.

[73] Assignee: Halliburton Energy Services, Inc., Dallas, Tex.

[21] Appl. No.: 08/907,556

[22] Filed: Aug. 8, 1997

[51] Int. Cl.[7] ..... E21B 34/04

[52] U.S. Cl. ..... 166/344; 166/336; 60/372; 60/413; 60/416

[58] Field of Search ..... 166/336, 368, 166/338, 344, 347; 60/372, 413, 416

[56] References Cited

U.S. PATENT DOCUMENTS

| | | | |
|---|---|---|---|
| 4,135,547 | 1/1979 | Akkerman et al. | 137/315 |
| 4,361,188 | 11/1982 | Russell | 166/381 |
| 4,378,848 | 4/1983 | Milberger | 166/362 |
| 4,636,934 | 1/1987 | Schwendemann et al. | 364/132 |
| 4,732,214 | 3/1988 | Yates | 166/336 |
| 4,880,060 | 11/1989 | Schwendemann et al. | 166/336 |
| 5,101,907 | 4/1992 | Schultz et al. | 166/386 |
| 5,238,070 | 8/1993 | Schultz et al. | 166/386 |
| 5,832,996 | 11/1998 | Carmody et al. | 166/53 |

*Primary Examiner*—William Neuder
*Assistant Examiner*—Zakiya Walker
*Attorney, Agent, or Firm*—Paul I. Herman; J. Richard Konneker

[57] ABSTRACT

A control module system provides convenient and economical operation of downhole tools, which operation is controllable from a remote location. In a described embodiment, a control module system includes a control circuit configured to control selective opening of a plurality of valves interconnected between a plurality of accumulators and multiple tools, all positioned within the well. Additionally, the control circuit communicates with a terminal at the earth's surface for transmitting instructions from the terminal to the control circuit, and for transmitting data from the control circuit to the terminal.

50 Claims, 4 Drawing Sheets

CONTROL MODULE SYSTEM FOR SUBTERRANEAN WELL

BACKGROUND OF THE INVENTION

The present invention relates generally to operations performed in a subterranean well and, in an embodiment described herein, more particularly provides a system for remotely controlling operation of tools positioned within the well.

A large variety of tools have been designed to operate within subterranean wells. Of these, many are operated by application of fluid pressure, or differential fluid pressure, thereto. For example, tester valves, retainer valves, subsea test trees, pressure actuated sliding sleeve valves, etc. all depend for their operation, at least in part, on fluid pressure being applied selectively thereto in order to accomplish an objective, such as opening or closing a flow passage.

In some circumstances, fluid pressure may be applied directly to a pressure actuated tool in a well. For example, some circulating valves may be opened by merely applying fluid pressure at the earth's surface to a tubing string in which the circulating valve is interconnected. In that case, the tubing string directly transmits the fluid pressure from the earth's surface to the circulating valve.

However, in other circumstances, it is not practical for downhole tools to be operated by application of fluid pressure to a tubing string. One of these circumstances is where multiple tools having multiple modes of operation are utilized. For example, in a subsea well testing operation, it is common to interconnect both a retainer valve and a subsea test tree in the tubing string. Each of the retainer valve and the test tree typically requires a control line and a balance line connected thereto, and the test tree typically requires a latch line connected thereto. Additionally, an injection line may be interconnected to the test tree in order to permit injection of fluid, such as chemical treatment fluid, into the tubing string.

Heretofore, the control lines, balance lines, latch line and injection line have been bundled and attached externally to the tubing string extending to the earth's surface. Unfortunately, however, this situation creates a number of problems. Installation of the lines and associated equipment is difficult and time-consuming and, therefore, expensive. The bundle of lines is susceptible to damage both during and after installation. Additionally, the lines themselves are very expensive and usually not reusable.

These problems, and others, are present in varying degrees in other operations involving downhole tools which are pressure actuated. In general, where it is has not been feasible or desirable to utilize the tubing string or the annulus between the tubing string and the wellbore to transmit fluid pressure from the earth's surface for operation of these tools, the fluid pressure has been transmitted through lines extending from the earth's surface to the tools.

From the foregoing, it can be seen that it would be quite desirable to provide a system for operating a pressure actuated downhole tool which eliminates or minimizes the number of lines extending to the earth's surface, which is convenient in installation and operation, which is economical and which minimizes damage to lines in its installation. Additionally, it would be desirable for the system to permit communication between the earth's surface and a downhole portion of the system, so that the system may be remotely controlled from the earth's surface and/or the downhole portion of the system may transmit data to the earth's surface. It is accordingly an object of the present invention to provide such a system and associated methods of controlling downhole tools.

SUMMARY OF THE INVENTION

In carrying out the principles of the present invention, in accordance with an embodiment thereof, a system is provided which includes a control module and a pressure storage device positioned downhole and interconnected with a pressure actuated tool. The control module is in communication with the earth's surface and, upon transmission of an appropriate instruction from the earth's surface, permits fluid communication between the pressure storage device and the tool for actuation of the tool. The system is reusable, is convenient to install and operate, and minimizes the use of lines extending to the earth's surface. Associated methods are also provided.

In broad terms, apparatus is provided which includes an accumulator, a control circuit and a valve interconnected between the accumulator and a pressure actuated tool. The control circuit is positioned downhole and is in communication with the earth's surface via an electrical conductor, acoustic transmission, fiber optic cable, or other remote communication means. Where an electrical conductor is used, the control circuit may be powered thereby, otherwise the control circuit may be powered by a battery connected thereto. Upon receipt of an appropriate instruction from the earth's surface, the control circuit causes the valve to open, thereby permitting fluid pressure to transfer from the accumulator to the tool.

In another aspect of the present invention, a tool having multiple modes of operation may be interconnected to the accumulator utilizing multiple valves. The control circuit would then open one of the valves upon receipt of one certain instruction, open another one of the valves upon receipt of a different instruction and/or prevent certain valves from being open while other valves are open, etc. Thus, the control circuit may be utilized both to carry out specific instructions from the earth's surface, and to perform preprogrammed functions.

In yet another aspect of the present invention, the control circuit may be utilized to transmit data to the earth's surface. For example, the control circuit may transmit data indicating whether one or more valves are open or closed. As another example, the control circuit may transmit data corresponding to a property, such as temperature, pressure, etc., detected by a sensor positioned downhole and connected to the control circuit.

In still another aspect of the present invention, separate pressure storage devices may be provided and positioned downhole for performance of separate or overlapping functions. For example, a pressure storage device may be dedicated for use in supplying fluid pressure to a latch line of a subsea test tree. As another example, another pressure storage device may serve as a dump chamber interconnected to one or more bleed ports of the tools. In yet another aspect of the present invention, the dump chamber may be utilized as a backup for another accumulator.

In still another aspect of the present invention, one or more of the accumulators may be charged with fluid pressure via a line extending to the earth's surface. This line may also serve as an injection line or have another purpose. The control circuit selectively permits fluid communication between the line and one or more of the accumulators in response to an instruction from the earth's surface.

A terminal may be utilized at the earth's surface for communication with the control circuit. The terminal is capable of transmitting appropriate instructions and receiving data transmissions from the control circuit.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
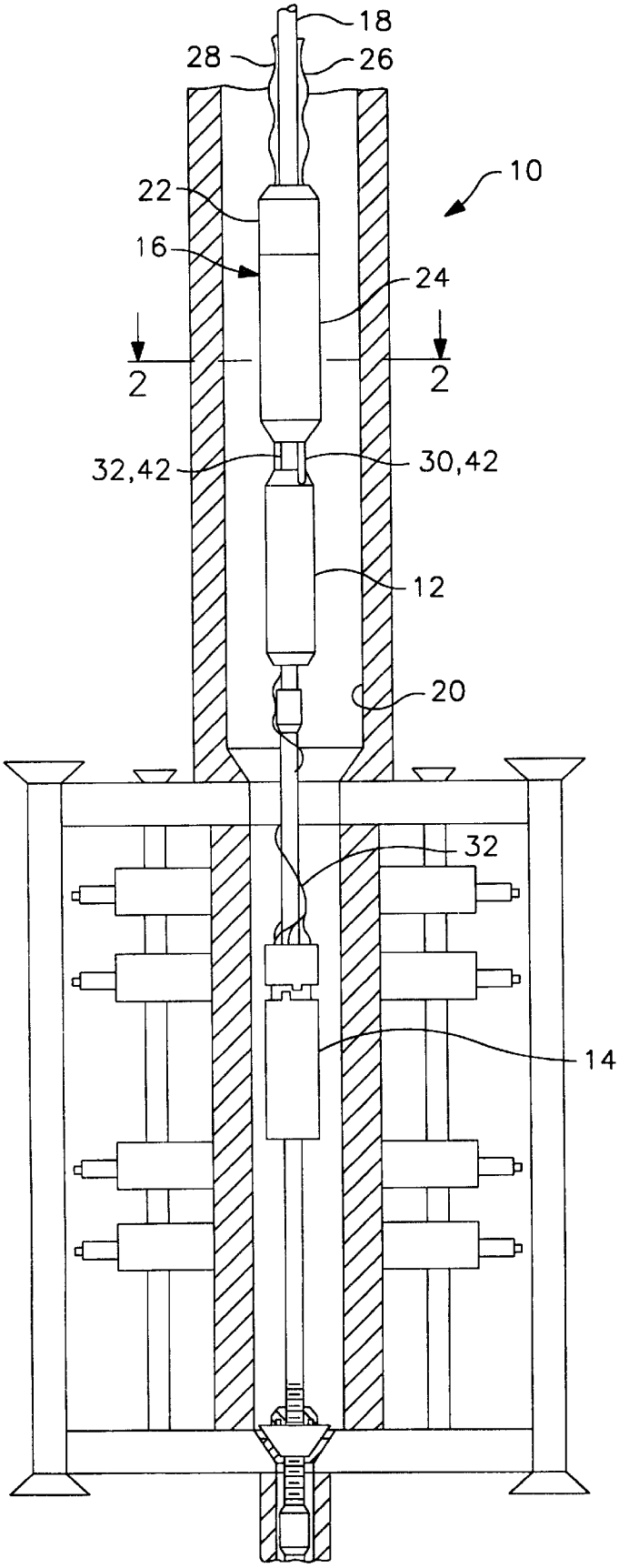
FIG. 1 is a schematic representation of a control module system utilized in a subsea well testing operation, the control module system embodying principles of the present invention.

Representatively and schematically illustrated in FIG. 1 is a control module system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The system 10 is interconnected to a conventional retainer 12 and a conventional subsea test tree 14. A downhole portion 16 of the system 10 is interconnected above the retainer 12 and test tree 14 in a tubing string 18 extending to the earth's surface. The tubing string 18, including the downhole portion 16, retainer 12 and test tree 14, is positioned within a bore 20 of a subterranean well. It is to be clearly understood that, although the system 10 is described herein as being utilized in a subsea well testing operation with the retainer 12 and test tree 14, the system may also be utilized in other operations and with other tools, without departing from the principles of the present invention.

The downhole portion 16 of the system 10 includes a control module 22 and an accumulator portion 24. As will be more fully described hereinbelow, the control module 22 is in communication with the earth's surface and, in response to instructions received therefrom, the control module selectively controls fluid communication between the accumulator portion 24 and the retainer 12 and test tree 14. The control module 22 also transmits data to the earth's surface relating to operation of the system 10, properties sensed by sensors, etc.

The control module 22 may be in communication with the earth's surface via a communication line 26 connected thereto and extending to the earth's surface. The communication line 26 may be an electrical conductor, in which case the control module 22 may communicate with the earth's surface by, for example, conventional methods utilized in wireline operations and well known to those of ordinary skill in the art. Furthermore, where an electrical conductor is used for the communication line 26, the control module 22 may receive its power from the electrical conductor. Alternatively, power for operation of the control module 22 may be otherwise supplied, for example, by a battery connected to the control module (see FIG. 3 and accompanying description).

A fiber optic cable or other communication means may be used for the communication line 26, or in place thereof, without departing from the principles of the present invention. If the communication line 26 is a fiber optic cable, light waves carried by the cable may be transmitted between the earth's surface and the control module 22, thus providing remote operation of the control module and remote reception of data transmitted from the control module. Conventional methods and apparatus for such transmission via fiber optic cable may be utilized in the system 10.

It is to be understood that all means of communication between the control module 22 and the earth's surface which may be utilized in the system 10 do not require the use of the communication line 26. For example, acoustic or radio frequency data transmission may be used, in which case the communication line 26 is not needed. Conventional methods and apparatus for such acoustic or radio frequency transmission and reception may be utilized in the system 10.

Another line 28 extends to the earth's surface. The line 28 may be an injection line, in which case it may be placed in fluid communication with the interior of the tubing string 18 for injection of fluid, such as a chemical, etc., into the tubing string in a conventional manner. As will be more fully described hereinbelow, the line 28 may also be utilized in the system 10 to transmit fluid pressure from the earth's surface to accumulators 36 (see FIGS. 2–4) disposed within the accumulator portion 24.

Lines 30 are interconnected between the downhole portion 16 and the retainer 12. In the representatively illustrated system 10, the lines 30 include a control line, a balance line, a control bleed line and a balance bleed line (see FIG. 3). The control line is connected to a control line port, the balance line is connected to a balance line port, the control bleed line is connected to a control line bleed port and the balance bleed line is connected to a balance line bleed port of the retainer 12. These ports are typically provided on conventional retainers and are well known to those of ordinary skill in the art.

In operation of the retainer 12, fluid pressure is applied to the control line port thereof to open a ball valve within the retainer, fluid pressure is applied to the balance line port if needed to assist in closing the ball valve, fluid pressure is bled from the control line to the control line bleed port when the ball valve is closed, and fluid pressure is bled from the balance line to the balance line bleed port when the ball valve is opened. It is to be understood that the retainer 12 may be provided with other or different ports, and the lines 30 may include other or different lines corresponding thereto, without departing from the principles of the present invention.

Lines 32 are interconnected between the downhole portion 16 and the test tree 14. In the representatively illustrated system 10, the lines 32 include a control line, a balance line, a control bleed line, a balance bleed line, a latch line and the injection line 28 (see FIG. 3). The control line is connected to a control line port, the balance line is connected to a balance line port, the control bleed line is connected to a control line bleed port, the balance bleed line is connected to a balance line bleed port, and the latch line is connected to a latch line port of the test tree 14. These ports are typically provided on conventional subsea test trees and are well known to those of ordinary skill in the art.

In operation of the test tree 14, fluid pressure is applied to the control line port thereof to open a ball valve within the test tree, fluid pressure is applied to the balance line port if needed to assist in closing the ball valve, fluid pressure is bled from the control line to the control line bleed port when the ball valve is closed, and fluid pressure is bled from the balance line to the balance line bleed port when the ball valve is opened. Fluid pressure is applied to the latch line port in order to axially separate the test tree 14, thereby permitting the ball valve to remain in place while an upper portion of the test tree and the remainder of the tubing string 18 is retrieved from the well. It is to be understood that the test tree 14 may be provided with other or different ports, and the lines 32 may include other or different lines corresponding thereto, without departing from the principles of the present invention.

The ball valves in each of the retainer 12 and test tree 14 are conventionally used to selectively permit or prevent fluid flow through the tubing string 18. Thus, by utilizing the control module system 10 in conjunction with the retainer 12 and test tree 14, the ball valves may be remotely opened or closed as desired from the earth's surface, without the need for multiple fluid pressure lines extending to the earth's surface.

Figure 2:
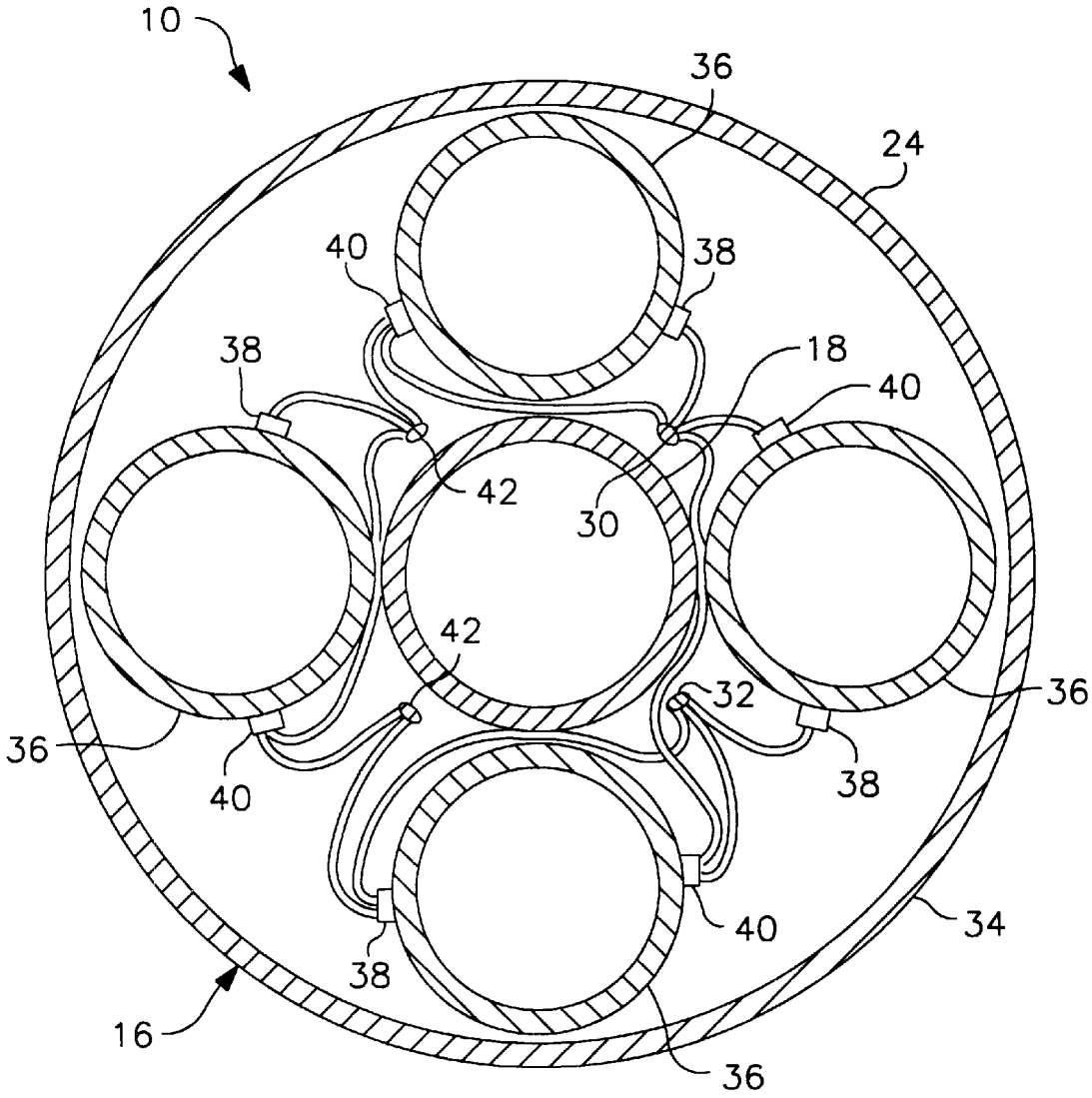
FIG. 2 is an enlarged scale cross-sectional view through the system of FIG. 1, showing an accumulator portion of the system, taken along line 2—2 of FIG. 1.

Referring additionally now to FIG. 2, an enlarged cross-sectional view of the accumulator portion 24 is representatively illustrated, taken along line 2—2 of FIG. 1. In FIG. 2 it may be clearly seen that the accumulator portion 24 includes a generally tubular housing 34 radially outwardly surrounding the tubing string 18. Circumferentially spaced apart between the tubing string 18 and the housing 34 are a series of accumulators 36.

The accumulators 36 are fluid pressure storage devices that may be at least partially charged with fluid pressure before the downhole portion 16 is installed in the well. Four of the accumulators 36 are shown in FIG. 2, and the accumulators are generally tubular in shape. However, it is to be understood that different numbers of the accumulators 36, differently shaped accumulators, and otherwise positioned accumulators may be utilized in the system 10 without departing from the principles of the present invention. For example, the accumulators 36 may be distributed axially, instead of circumferentially, about the tubing string 18, the accumulators may be integrally formed with the tubing string, there may be only a single accumulator, the accumulators may be annular shaped, etc.

Fluid pressure lines, such as lines 30 and 32 may extend within the housing 34. Various of the lines 30, 32 are interconnected to solenoid valves 38, which are, in turn, interconnected to the accumulators 36. As will be more fully described hereinbelow, selective opening and closing of selected ones of the valves 38 is controlled by the control module 22. When one of the valves 38 is opened, fluid communication is permitted between its corresponding accumulator 36 and one or more of the lines 30, 32. For example, if it is desired to open the ball valve in the retainer 12, the corresponding valve 38 interconnected between the appropriate accumulator 36 and the control line port of the retainer is opened, thereby applying fluid pressure from the accumulator to the retainer control line port.

The valves 38 are described herein as discrete solenoid valves, each of which are separately operable upon receipt of an appropriate signal from the control module 22. For example, if one of the valves 38 is a solenoid valve which is openable by a certain voltage and/or current applied thereto, the appropriate signal from the control module 22 to open the valve would be that certain voltage and/or current. As an alternative to discrete solenoid valves, some or all of the valves 38 may be combined, for example, using an integrally formed manifold, etc., certain ones of the valves may be combined into a two-way, three-way, etc. valve, the valves may be pilot valves, pneumatically or hydraulically operated valves, etc., without departing from the principles of the present invention.

The control module 22 is also interconnected to a number of sensors 40 on the accumulators 36 and elsewhere in the well, for example, on the retainer 12 and/or the test tree 14 (see HG. 3). The sensors 40 may detect a fluid property, such as temperature, pressure, etc., in which case the sensors may be conventional pressure transducers, thermocouples, strain gauges, thermistors, etc., or they may detect a configuration of the system 10 and/or the tools to which it is attached. For example, one of the sensors 40 may be a conventional proximity sensor connected to the retainer 12 in a manner enabling the sensor to detect whether the retainer's ball valve is open or closed, etc. The sensors 40 are interconnected to the control module 22 via lines 42 extending within the accumulator housing 34.

Figure 3:
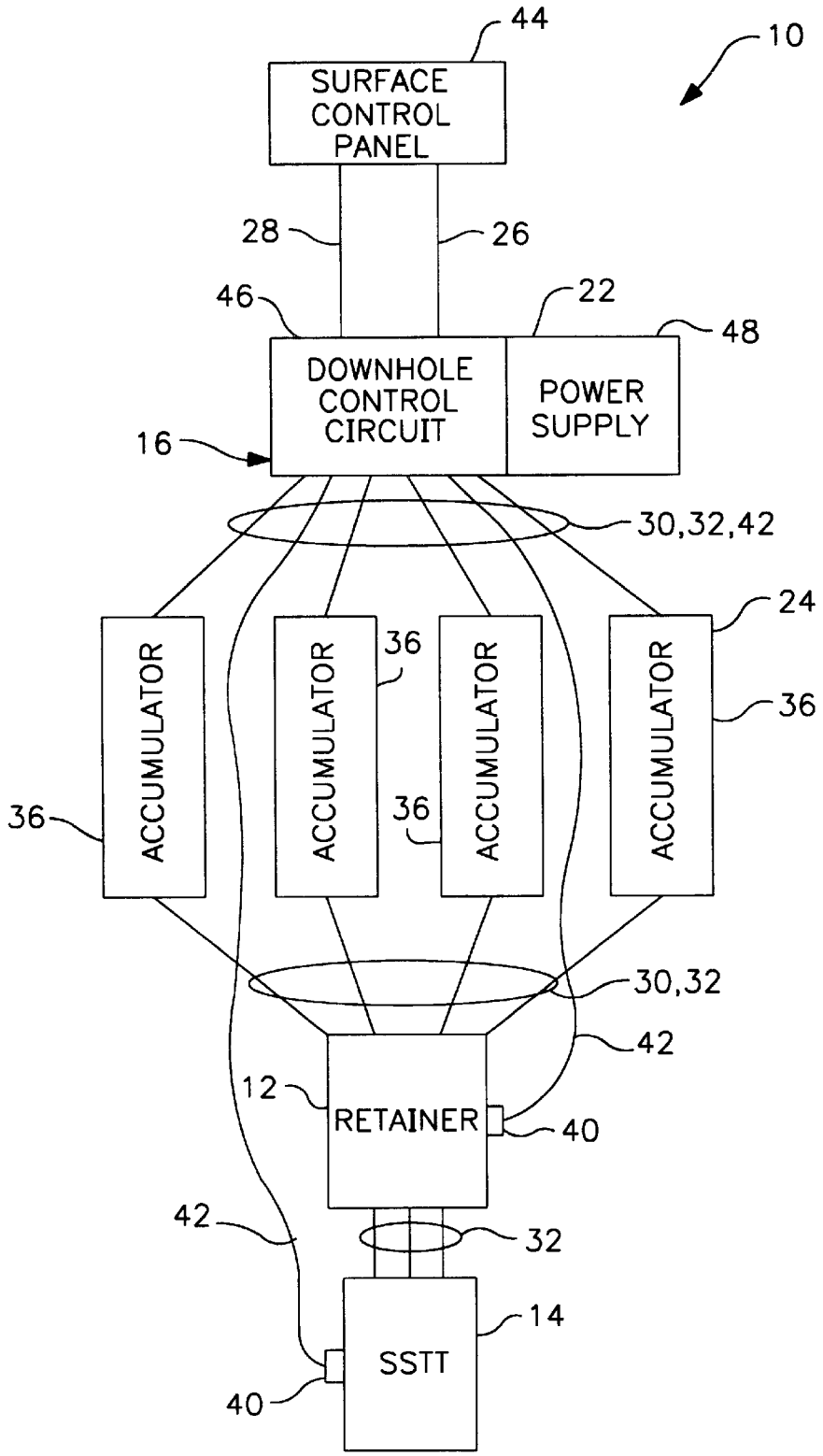
FIG. 3 is a diagrammatic representation of the system of FIG. 1, showing interconnections between elements of the system and tools operated thereby.

Referring additionally now to FIG. 3, the system 10 and its associated tools 12, 14 are diagrammatically and representatively illustrated. In this view it may be clearly seen that the control module 22 is interconnected to a terminal, or surface control panel 44, at the earth's surface. Specifically, the communication line 26 extends from the control panel 44 to a downhole control circuit 46 within the control module 22. Of course, if a means of communication between the control panel 44 and control circuit 46 is utilized which does not require use of a line 26, such as acoustic or radio frequency transmission, there may be no physical interconnection between the control panel and the control circuit. The control panel 44 may also be interconnected to the injection line 28, in order to control application of fluid pressure thereto, for example, for injection of a fluid into the tubing string 18, or for supplying fluid pressure to one or more of the accumulators 36 as will be described more fully hereinbelow.

The surface control panel 44 may be of the type conventionally used in wireline operations for communicating with, supplying power to, and relaying instructions to, logging tools, etc., attached to a wireline. Such terminals or control panels are well known in the art and are frequently used in wellsite operations. A person of ordinary skill in the art would be able to readily produce a control panel capable of performing the functions of the control panel 44 described herein without undue experimentation. It is to be clearly understood that the control panel 44 may be other than a wireline type control panel without departing from the principles of the present invention. For example, if radio frequency, acoustic or fiber optic data transmission is used for communicating between the control panel 44 and the control circuit 46, the control panel would be appropriately configured for the selected communication means.

The control circuit 46 may be of the type conventionally used in wireline logging tools for communicating with, receiving power from, and transmitting data to, a terminal on the earth's surface. Such control circuits are well known in the art and are frequently used in wellsite operations. A person of ordinary skill in the art would be able to readily produce a control circuit capable of performing the functions of the control circuit 46 described herein without undue experimentation. It is to be clearly understood that the control circuit 46 may be other than a wireline type control circuit without departing from the principles of the present invention. For example, if radio frequency, acoustic or fiber optic data transmission is used for communicating between the control panel 44 and the control circuit 46, the control circuit would be appropriately configured for the selected communication means.

It is to be clearly understood that in a system constructed in accordance with the principles of the present invention, it is not necessary that the control circuit 46 communicate directly with the control panel 44, nor is it necessary for the control panel to be provided. For example, the control circuit 46 may communicate with, and/or receive instructions, signals, etc. from, an electronic device located within the well, either proximate to, or remote from, the control circuit. The electronic device may be, for example, a repeater which repeats instructions, signals, etc. transmitted to and/or from the control panel 44, an "intelligent" device which is capable of communicating with the control circuit 46 without requiring specific instructions from the earth's surface, etc. Thus, it is not necessary for the control circuit 46 to communicate directly with the earth's surface.

In the representatively illustrated system 10, the control circuit 46 communicates with the control panel 44, controls the valves 38, receives data from the sensors 40, and performs other functions described more fully below. Power for operation of the control circuit 46 may be supplied via the communication line 26 as described above, or the power may be supplied by a battery, or other power supply 48, within the control module 22 and connected to the control circuit. It is to be understood that power may be otherwise supplied to the control circuit 46 without departing from the principles of the present invention.

In FIG. 3, it may be clearly seen that the control circuit 46 is interconnected to the accumulators 36 and tools 12, 14, and sensors 40 and valves 38 thereon, via the lines 30, 32, 42 extending therebetween. For illustrative clarity, the valves 38 and sensors 40 associated with the accumulators 36 are not shown in FIG. 3 (see FIGS. 2 & 4). At this point, it is instructive to note the minimization of the number of lines extending to the earth's surface in the system 10. As shown in FIG. 3, only the communication line 26 and injection line 28 extend from the downhole control module 22 and the surface control panel 44, and even these may be eliminated in the system 10, for example, if a communication means is selected which does not require use of the communication line, the control circuit 46 is powered by the downhole power supply 48, and the injection line 28 is not used to recharge one or more of the accumulators 36. Thus, the system 10 minimizes, or eliminates, the lines extending to the earth's surface, speeds installation, and is more economical and efficient in installation and operation. Additionally, the system 10 provides increased functionality in that it is capable of communicating data to the earth's surface, for example, data relating to properties sensed by the sensors 40, configuration of the system, etc.

Figure 4:
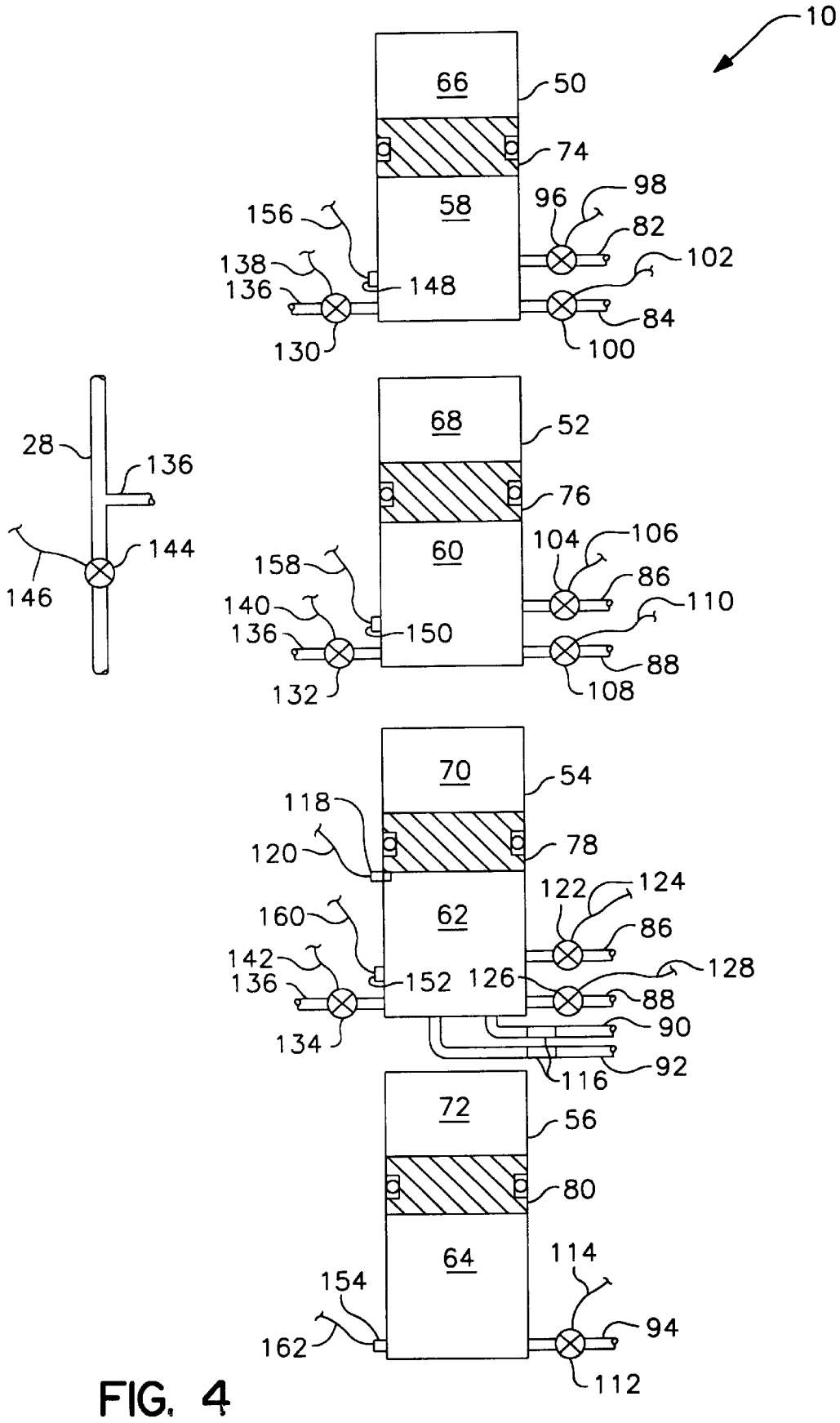
FIG. 4 is a schematic representation of the system of FIG. 1, showing interconnections with accumulators thereof.

Referring additionally now to FIG. 4, the accumulators 36 are schematically and representatively illustrated, showing their interconnections to the remainder of the system 10. For convenience in referring to each of the accumulators 36, valves 38, sensors 40 and lines 30, 32, 42, individual reference numbers are used for the individual elements shown in FIG. 4. However, it is to be clearly understood that the system 10 shown in FIG. 4 is the same as the system 10 shown in FIGS. 1–3, which is an exemplary embodiment of the present invention.

In FIG. 4, four accumulators 50, 52, 54, 56 are representatively illustrated. The accumulators 50, 52, 54, 56 are schematically indicated as being of the type having a liquid chamber 58, 60, 62, 64, separated from a compressible fluid chamber 66, 68, 70, 72 by a piston 74, 76, 78, 80, respectively, sealingly and redprocably disposed therebetween. The compressible fluid in the chambers 66, 68, 70, 72 may be a gas, such as nitrogen, and may be pressurized therein at the earth's surface before the system 10 is installed in the well. It is to be clearly understood, however, that the accumulators 50, 52, 54, 56 may be another type of pressure storage device, may be differently configured, may utilize any type of compressible fluid, and may be otherwise pressurized without departing from the principles of the present invention.

In at least the accumulators 50, 52, and 56, a liquid, such as water, is introduced into the chambers 58, 60, 64. This liquid may be introduced therein at the earth's surface, or it may be introduced after the system 10 is installed in the well. In operation, fluid pressure in each of the chambers 58, 60, 64 is typically equal to fluid pressure in its respective one of the chambers 66, 68, 72. Of course, the pistons 74, 76, 80 and chambers 66, 68, 72, 58, 60, 64 may be otherwise configured, for example, to produce different fluid pressures between the compressible fluids and the liquids, without departing from the principles of the present invention.

As used in the system 10 described herein, the accumulator 50 is interconnected to the control line 82 and balance line 84 of the retainer 12, the accumulator 52 is interconnected to the control line 86 and balance line 88 of the test tree 14, the accumulator 54 is interconnected to the control line 86 and balance line 88 of the test tree and to the control bleed line 90 and balance bleed line 92 of the test tree, and the accumulator 56 is interconnected to the latch line 94 of the test tree. In this configuration, the accumulator 50 is used to supply fluid pressure for actuating the retainer 12, the accumulator 52 is used to supply fluid pressure for actuating the test tree 14, the accumulator 54 serves as a disposal chamber for fluid pressure bled from the test tree control and balance line ports, and the accumulator 56 is used to supply fluid pressure to the latch line port of the test tree.

It will be readily appreciated by a person of ordinary skill in the art that the accumulators 50, 52, 54, 56 may be easily otherwise configured and/or interconnected to the tools 12, 14. For example, all of the control and balance lines 82, 84, 86, 88 could be connected to a single accumulator, the control, balance, control bleed, and balance bleed lines of the retainer could also be connected to the accumulator 54 or to another accumulator not shown in FIG. 4, the latch line 94 could be connected to one of the accumulators 50, 52, etc. The configuration shown in FIG. 4 is, thus only an example of the wide variety of interconnections possible between accumulators and tools in the system 10 and it is to be clearly understood that other configurations may be utilized without departing from the principles of the present invention.

Note that, in FIG. 4, no connection is shown between the retainer 12 bleed lines and any of the accumulators 50, 52, 54, 56, and that the retainer control and balance lines 82, 84 are shown connected to only one accumulator 50. For illustrative clarity these connections have not been shown in FIG. 4, however, it will be readily appreciated that the retainer control, balance, control bleed, and balance bleed lines may be easily interconnected to the accumulator 54 in a manner similar to the way in which the test tree control, balance, etc. lines are connected thereto, or that the retainer control, balance, etc. lines may easily be connected to another accumulator similar to the representatively illustrated accumulator 54. Thus, the accumulator 54 may also serve as a disposal chamber and/or backup fluid pressure supply for the retainer 12.

To open the retainer 12, an appropriate signal is transmitted from the control circuit 46 to a valve 96 interconnected between the chamber 58 and the control line 82, to thereby open the valve 96. The signal is transmitted via a line 98 interconnected between the control circuit 46 and the valve 96. To close the retainer 12, an appropriate signal is transmitted from the control circuit 46 to a valve 100 interconnected between the chamber 58 and the balance line 84, to thereby open the valve 100. The signal is transmitted via a line 102 interconnected between the valve 100 and the control circuit 46. Preferably, the control circuit 46 includes a microprocessor or other circuitry which is programmed to prevent simultaneous opening of the valves 96, 100, that is, the control circuit is permitted to send an appropriate signal to only one of the valves 96, 100 at a time. The control circuit 46 transmits signals to the valves 96, 100 upon receipt of appropriate instructions from the surface control panel 44. Thus, such programming to prevent simultaneous opening of the valves 96, 100 may alternatively be within the control panel 44 circuitry, or may be otherwise positioned, without departing from the principles of the present invention.

To open the test tree 14, an appropriate signal is transmitted from the control circuit 46 to a valve 104 interconnected between the chamber 60 and the control line 86, to thereby open the valve 104. The signal is transmitted via a line 106 interconnected between the control circuit 46 and the valve 104. To close the test tree 14, an appropriate signal is transmitted from the control circuit 46 to a valve 108 interconnected between the chamber 60 and the balance line 88, to thereby open the valve 108. The signal is transmitted via a line 110 interconnected between the valve 108 and the control circuit 46. As with operation of the retainer 12 described above, the control circuit 46 and/or control panel 44 preferably includes a microprocessor or other circuitry which is programmed to prevent simultaneous opening of the valves 104, 108, or such programming may be otherwise positioned without departing from the principles of the present invention. The control circuit 46 transmits signals to the valves 104, 108 upon receipt of appropriate instructions from the surface control panel 44.

Note that, to close the test tree 14, it may not be necessary to apply fluid pressure to the balance line 88, since the test tree may be of the type which is "normally closed", that is, the test tree closes upon an absence of a minimum fluid pressure in the control line 86. The retainer 12 may be similarly configured. Thus, it is to be clearly understood that the descriptions herein of sequences of steps to be performed, and fluid pressures to be applied to specific lines, in actuation of the tools 12, 14 are for purposes of example only, and that other sequences, pressure applications, lines, etc., may be utilized without departing from the principles of the present invention.

To unlatch the test tree 14, an appropriate signal is transmitted from the control circuit 46 to a valve 112 interconnected between the chamber 64 and the latch line 94, to thereby open the valve 112. The signal is transmitted via a line 114 interconnected between the control circuit 46 and the valve 112. The control circuit 46 transmits the signal to the valve 112 upon receipt of an appropriate instruction from the surface control panel 44. Somewhat similar to operation of the retainer 12 and test tree 14 described above, the control circuit 46 and/or control panel 44 preferably includes a microprocessor or other circuitry which is programmed to prevent simultaneous opening of the valves 112, 96, 104, or such programming may be otherwise positioned without departing from the principles of the present invention. It will be readily appreciated by one of ordinary skill in the art that fluid pressure should not be applied to the latch line 94 while either one of the retainer 12 or test tree 14 is open, in order to prevent uncontrolled escape of fluid from within the tubing string 18. However, it is to be clearly understood that the control circuit 46 and/or control panel 44 may be otherwise programmed without departing from the principles of the present invention.

When the test tree 14 is opened or closed by opening a corresponding one of the valves 104, 108, fluid is bled from the opposite one of the lines 86, 88 via one of the bleed lines 90, 92. For example, when fluid pressure is applied to the control line 86, fluid pressure in the balance line 88 is bled through the balance bleed line 92, and when fluid pressure is applied to the balance line 88, fluid pressure in the control line 86 is bled through the control bleed line 90. In the system 10, the bleed lines 90, 92 are interconnected to the chamber 62, a check valve 116 in the lines preventing reverse flow therethrough. Therefore, the chamber 62 is gradually filled with fluid as the test tree 14 is opened and closed during operations within the well. As described above, the retainer 12 may be interconnected to the chamber 62, or another similar chamber, if desired.

It will be readily apparent to one of ordinary skill in the art that the fluid from the bleed lines 90, 92 which gradually fills the chamber 62 is initially present in the chamber 60. Thus, as the chamber 62 fills, the chamber 60 empties. In an important aspect of the present invention, the accumulator 54 includes features which permit it to be used as a fluid pressure source for operation of the test tree 14, in the event that the fluid in the chamber 60 is no longer available.

A latching device 118 is interconnected via a line 120 to the control circuit 46. The latching device 118 may be a conventional solenoid, radially expandable annular ring, or any other device capable of releasably securing the piston 78 relative to the chamber 62. Initially, the latching device 118 prevents axially downward displacement of the piston 78 as shown in FIG. 4, so that fluid pressure within the chamber 70 is not applied to the chamber 62. In this way, fluid may be bled through the bleed lines 90, 92 into the chamber 62 with minimal back pressure thereon.

When the chamber 60 no longer contains sufficient fluid for actuation of the test tree 14, the latching device 118 may be activated by transmission of an appropriate signal from the control circuit 46 to the latching device via the line 120 to thereby release the piston 78. The piston 78 then displaces axially downward to equalize fluid pressures between the chambers 70, 62. Thence forward, the valves 104, 108 are not used to operate the test tree 14. To open the test tree 14 after the piston 78 has been released, an appropriate signal is transmitted from the control circuit 46 to a valve 122 interconnected between the chamber 62 and the control line 86, to thereby open the valve 122. The signal is transmitted via a line 124 interconnected between the control circuit 46 and the valve 122. To close the test tree 14, an appropriate signal is transmitted from the control circuit 46 to a valve 126 interconnected between the chamber 62 and the balance line 88, to thereby open the valve 126. The signal is transmitted via a line 128 interconnected between the valve 126 and the control circuit 46.

It will be readily appreciated that other methods may be used to transfer fluid pressure stored in chamber 70 to chamber 62. For example, instead of the piston 78, another type of barrier, such as a valve (not shown), may be interconnected between the chambers 70, 62. Initially, the valve may be closed to isolate the chambers 70, 62.

However, when it is desired to utilize the fluid pressure stored in the chamber 70 for operation of the test tree 14, the valve may be opened by an appropriate signal transmitted on the line 120 to the valve, thereby providing fluid communication between the chambers 70, 62.

Any of the chambers 58, 60, 62 may be charged or recharged with fluid pressure from the injection line 28 or other line extending to the earth's surface. I n this manner, the injection line 28 may serve as a fluid pressure source for the accumulators 50, 52, 54 and, thus, for the tools 12, 14. A valve 130, 132, 134 is interconnected between a respective one of the chambers 58, 60, 62 and the injection line 28 via a line 136 extending therebetween. If it is desired to apply fluid pressure from the injection line 28 to the chamber 58, an appropriate signal is transmitted from the control circuit 46 to the valve 130 via a line 138 interconnected therebetween. Similarly, if it is desired to apply fluid pressure from the injection line 28 to the chamber 60, an appropriate signal is transmitted from the control circuit 46 to the valve 132 via a line 140 interconnected therebetween, and if it is desired to apply fluid pressure from the injection line to the chamber 62, an appropriate signal is transmitted from the control circuit to the valve 134 via a line 142 interconnected therebetween.

It will be readily apparent to one of ordinary skill in the art that the ability to recharge the chambers 58, 60 using the injection line 28 enables the chambers 58, 60 to be refilled with fluid. Therefore, it is not necessary to provide the accumulator 54 and its associated valves 122, 126, lines 124, 128, etc. in the system 10. For example, if the chamber 60 no longer had sufficient fluid therein to operate the test tree 14, the valve 132 could be opened to thereby permit fluid from the injection line 28 to refill the chamber 60. Thus, it may be desired to utilize the accumulator 54 i n circumstances in which it is not desired to install the injection line 28 or other fluid pressure source extending to the earth's surface.

Note that the injection line 28 may also be utilized to conduct fluid to the interior of the tubing string 18 by opening a valve 144 interconnected therebetween. The valve 144 may be opened by transmitting an appropriate signal from the control circuit 46 to the valve 144 via a line 146 interconnected therebetween.

Each of the accumulators 50, 52, 54, 56 has a sensor 148, 150, 152, 154, respectively, attached thereto. Each of the sensors 148, 150, 152, 154 is interconnected to the control circuit 46 via a line 156, 158, 160, 162, respectively. The sensors 148, 150, 152, 154 may sense fluid pressure within the accumulators 50, 52, 54, 56, temperature, proximity of the pistons 74, 76, 78, 80, etc., or any combination thereof. Additionally, certain ones of the accumulators 50, 52, 54, 56 may have different sensors attached thereto, no sensors attached thereto, etc., without departing from the principles of the present invention. The control circuit 46 receives readings, data, etc. from the sensors 148, 150, 152, 154 and transmits these, or modified forms of these, to the control panel 44 at the earth's surface. In this manner, an operator at the earth's surface may, for example, recognize when one or more of the chambers 58, 60, 62, 64 contains sufficient fluid and/or fluid pressure to actuate the tools 12, 14, when the chambers should be recharged, downhole conditions, etc.

Thus has been described the system 10 which substantially reduces the number of lines extending to the earth's surface for control of downhole pressure actuated tools. The system 10 also permits communication of instructions from the control panel 44 at the earth's surface to the downhole control circuit 46, and transmission of data from the control circuit to the control panel. In addition, the system 10 permits operation of the tools to be controlled downhole by the control circuit 46. Furthermore, the system permits pressure storage devices to be positioned downhole, in relatively close proximity to the tools, and application of fluid pressure from the storage devices to the tools to be controlled from the earth's surface. These and other features and benefits of the system 10 and its associated methods enable more convenient and economical operations to be performed in the well.

Of course, many modifications, substitutions, additions, deletions, or other changes may be made in the system 10, which changes would be obvious to one of ordinary skill in the art, and these are contemplated by the principles of the present invention. For example, the accumulators 58, 60 may be combined, so that the retainer 12 and test tree 14 are opened and closed simultaneously, or so that they utilize the same fluid pressure source for their actuation. Accordingly, the foregoing detailed description is to be clearly understood as being given by way of illustration and example only, the spirit and scope of the present invention being limited solely by the appended claims.

What is claimed is:

1. Apparatus operatively positionable within a subterranean well for use in operation of, and in close proximity to, a pressure actuated tool operatively interconnected to a tubular string disposed within the well, the tool having a control line port and a control bleed port, the apparatus comprising:

a first pressure storage device attachable to the tubular string, the first pressure storage device having a first chamber therein, and the first pressure storage device being configured for interconnection of the control line port and the control bleed port to the first chamber.

2. The apparatus according to claim 1, wherein the tool further has a balance line port and a balance bleed port, and wherein the first pressure storage device is configured for interconnection of the balance line port and the balance bleed port to the first chamber.

3. The apparatus according to claim 1, further comprising a first valve interconnected to the first chamber, the first valve being operable upon receipt of a first signal, and the first valve being interconnectable to the control line port.

4. The apparatus according to claim 1, wherein the first pressure storage device is configured for interconnection of the first chamber to a fluid conduit extending to the earth's surface.

5. The apparatus according to claim 4, wherein the fluid conduit is an injection line interconnected to the interior of the tubular string.

6. The apparatus according to claim 4, further comprising a valve operable upon receipt of a signal, the valve being interconnected to the first chamber and interconnectable to the fluid conduit.

7. The apparatus according to claim 1, wherein the first pressure storage device further has a second chamber therein, the second chamber being separated from the first chamber by a barrier.

8. The apparatus according to claim 7, wherein the barrier is a piston isolating the first chamber from fluid communication with the second chamber.

9. The apparatus according to claim 8, wherein the piston is releasably secured against displacement relative to the remainder of the first pressure storage device.

10. The apparatus according to claim 9, further comprising a release mechanism releasably securing the piston against displacement, the release mechanism being operable to release the piston upon receipt of a signal.

11. Apparatus operatively positionable within a subterranean well for use in operation, and in close proximity to, a pressure actuated tool operatively interconnected to a tubular string disposed within the well, the tool having a control line port and a control bleed port, the apparatus comprising:

a first pressure storage device attachable to the tubular string, the first pressure storage device having a first chamber therein, and the first pressure storage device being configured for interconnection of the control line port and the control bleed port to the first chamber;

a first valve interconnected to the first chamber, the first valve being operable upon receipt of a first signal, and the first valve being interconnectable to the control line port; and a second valve interconnected to the first chamber, the second valve being operable upon receipt of a second signal, and the second valve being interconnectable to a balance line port of the tool.

12. Apparatus operatively positionable within a subterranean well for use in operation of, and in close proximity to, a pressure actuated tool operatively interconnected to a tubular string disposed within the well, the tool having a control line port and a control bleed port, the apparatus comprising:

a first pressure storage device attachable to the tubular string, the first pressure storage device having a first chamber therein, and the first pressure storage device being configured for interconnection of the control line port and the control bleed port to the first chamber; and a second pressure storage device attachable to the tubular string, the second pressure storage device having a second chamber therein, and the second pressure storage device being configured for interconnection of the control line port to the second chamber.

13. The apparatus according to claim 12, wherein the first pressure storage device is further configured for interconnection of the first chamber to an injection line extending to the earth's surface, and wherein the second pressure storage device is further configured for interconnection of the second chamber to the injection line.

14. The apparatus according to claim 13, further comprising first and second valves, the first valve being interconnected to the first chamber, and the second valve being interconnected to the second chamber, each of the first and second valves being operable to permit fluid communication between the injection line and a respective one of the first and second chambers upon receipt of a corresponding signal.

15. Apparatus for controlling operation of a pressure actuated tool operatively interconnected to a tubular string disposed within a subterranean well, the apparatus comprising:

a control module operatively attachable to the tubing string;

a pressure storage device;

a first valve interconnected to the control module and the pressure storage device, the first valve permitting fluid communication between the pressure storage device and the tool when the first valve receives a first signal from the control module; and tubing extending from a pressure source at the earth's surface to a second valve interconnected to the pressure storage device an to a third valve, the third valve being openable by the control module to thereby admit fluid pressure from the pressure source to the tubular string via the tubing.

16. The apparatus according to claim 15, wherein the second valve is openable by the control module to thereby admit fluid pressure from the pressure source to the pressure storage device.

17. Apparatus for controlling operation of a pressure actuated tool operatively interconnected to a tubular string disposed within a subterranean well, the apparatus comprising:

a control module operatively attachable to the tubing string;

first and second pressure storage devices;

a first valve interconnected to the control module and the first pressure storage device, the first valve permitting fluid communication between the first pressure storage device and the tool when the first valve receives a first signal from the control module; and a second valve interconnected to the second pressure storage device and the control module, the second valve permitting fluid communication between the second pressure storage device and the tool when the second valve receives a second signal from the control module, the control module being programmed to prevent the second signal from being transmitted while the first signal is being transmitted.

18. Apparatus for controlling operation of a pressure actuated tool operatively interconnected to a tubular string disposed within a subterranean well, the tool having a sensor connected thereto, the apparatus comprising:

a control module operatively attachable to the tubing string, the control module being connectable to the sensor, and the control module being capable of communicating a property detected by the sensor to a remote location;

a pressure storage device; and a first valve interconnected to the control module and the pressure storage device, the first valve permitting fluid communication between the pressure storage device and the tool when the first valve receives a first signal from the control module.

19. The apparatus according to claim 18, further comprising a tubing connected to the pressure storage device, the tubing being configured for connection to a bleed port of the tool.

20. The apparatus according to claim 18, further comprising an injection line extending to the earth's surface and second and third valves connected to the injection line and the control module, the second valve permitting fluid communication between the pressure storage device and the injection line when the second valve receives a second signal from the control module, and the third valve permitting fluid communication between the tubular string and the injection line when the third valve receives a third signal from the control module.

21. The apparatus according to claim 18, wherein the pressure storage device includes a latching device and a piston reciprocably received within a cylinder, the latching device releasably limiting displacement of the piston relative to the cylinder.

22. The apparatus according to claim 21, wherein the latching device is connected to the control module, and wherein the latching device releases the piston in response to a second signal received from the control module.

23. Apparatus operatively positionable within a subterranean well, the apparatus comprising:

a first valve openable by application of fluid pressure to a first port thereof, and closeable by application of fluid pressure to a second port thereof;

a fluid pressure source;

a second valve interconnected between the first port and the fluid pressure source, the second valve being selectively openable to provide fluid communication between the first valve and the fluid pressure source;

a control circuit connected to the second valve, the control circuit being capable of selectively opening the second valve; and a third valve interconnected between the fluid pressure source and the second port.

24. The apparatus according to claim 23, wherein the control circuit is connected to the third valve, and wherein the control circuit is capable of selectively opening the third valve upon receipt of a signal.

25. The apparatus according to claim 23, wherein the first valve is disconnectable from a tubular string by application of fluid pressure to a third port thereof, and further comprising a fourth valve interconnected between the fluid pressure source and the third port.

26. The apparatus according to claim 25, wherein the control circuit is connected to the fourth valve, and wherein the control circuit is capable of selectively opening the fourth valve upon receipt of a signal.

27. Apparatus operatively positionable within a subterranean well, the well having a tubular string disposed therein, and a plurality of valves interconnected in the tubular string, the valves selectively permitting and preventing fluid flow through the tubular string, the apparatus comprising:

a plurality of fluid pressure storage devices attachable to the tubular string, one of the fluid pressure storage devices being interconnected to a bleed port of one of the valves;

an electronic device capable of transmitting instructions; and a control module attachable to the tubular string, the control module selectively permitting and preventing fluid communication between each of the fluid pressure storage devices and a corresponding one of the valves when the control module receives a corresponding instruction from the electronic device.

28. The apparatus according to claim 27, wherein the one of the fluid pressure storage devices includes a piston reciprocably and sealingly received within a chamber.

29. The apparatus according to claim 28, wherein the piston divides the chamber into first and second portions, the bleed port being interconnected to the first portion, and the second portion having a compressible fluid therein.

30. The apparatus according to claim 29, wherein the piston is releasably secured against displacement relative to the chamber.

31. The apparatus according to claim 29, wherein fluid pressure in the second portion exceeds fluid pressure in the first portion.

32. The apparatus according to claim 29, wherein the first portion is interconnected to a control line port of the one of the valves.

33. The apparatus according to claim 32, wherein the first portion is interconnected to a balance line port of the one of the valves.

34. The apparatus according to claim 29, wherein the first portion is interconnected to a line extending to the earth's surface.

35. The apparatus according to claim 34, wherein the line is configured for interconnection to the tubular string, and wherein fluid is flowable from the earth's surface, through the line and into a selected one of the first portion and the tubular string.

36. A method of controlling operation of a tool positioned within a subterranean well, the method comprising the steps of:

positioning a control circuit and a first pressure storage device within the well;

interconnecting the first pressure storage device with the tool;

interconnecting the control circuit to the first pressure storage device;

transmitting fluid pressure between the first pressure storage device and the tool to thereby operate the tool;

positioning a second pressure storage device within the well;

releasably securing a piston within the second pressure storage device;

interconnecting the second pressure storage device to the control circuit and the tool; and transmitting fluid pressure between the second pressure storage device and the tool to thereby operate the tool.

37. The method according to claim 36, further comprising the step of releasing the piston prior to the step of transmitting fluid pressure between the second pressure storage device and the tool.

38. A method of controlling operation of a pressure actuated ball valve interconnected in a tubular string positioned within a subterranean well, the method comprising the steps of:

interconnecting a first valve between the ball valve and a first chamber;

applying fluid pressure to the first chamber;

opening the first valve in response to receipt of a first instruction;

interconnecting a second valve between the ball valve and a second chamber; and opening the second valve in response to receipt of a second instruction.

39. The method according to claim 38, further comprising the step of connecting a control circuit to the first and second valves, the control circuit being capable of receiving the first and second instructions, and the control circuit preventing opening of the first valve upon receipt of the second instruction and preventing opening of the second valve upon receipt of the first instruction.

40. The method according to claim 38, further comprising the steps of providing a data communication terminal at the earth's surface for transmitting the first and second instructions, and providing a control circuit for receiving the first and second instructions within the well.

41. The method according to claim 40, wherein in the control circuit providing step, the control circuit is configured for transmitting data to the terminal.

42. The method according to claim 41, further comprising the steps of disposing a sensor within the well, connecting the sensor to the control circuit, and utilizing the control circuit to transmit a property sensed by the sensor to the terminal.

43. The method according to claim 41, further comprising the step of utilizing the control circuit to transmit configurations of the first and second valves to the terminal.

44. A method of controlling operation of a pressure actuated tool, the method comprising the steps of:

interconnecting a bleed report of the tool to a first chamber of a pressure storage device, said pressure storage device having a second chamber sealingly separated from the first chamber;

actuating the tool, thereby transferring fluid pressure from the bleed port to the first chamber of the pressure storage device; and interconnecting the first chamber of the pressure storage device to a control line port of the tool.

45. The method according to claim 44, further comprising the step of actuating the tool utilizing the fluid pressure previously transferred to the pressure storage device from the bleed port.

46. The method according to claim 45, further comprising the step of interconnecting a valve between the pressure storage device and the control line port, the valve being operable upon receipt of a signal from the earth's surface.

47. The method according to claim 44, further comprising the step of releasably preventing fluid pressure transfer between first and second chambers of the pressure storage device.

48. The method according to claim 47, wherein the bleed and control line ports are interconnected to the first chamber.

49. The method according to claim 47, wherein the releasably preventing step is performed by releasably securing a piston against displacement relative to the first and second chambers.

50. The method according to claim 49, further comprising the step of releasing the piston for displacement in response to a signal.

* * * * *